US006158710A

United States Patent [19]

Matthews

[11] Patent Number: 6,158,710

[45] Date of Patent: Dec. 12, 2000

[54] CONCRETE FORMING SYSTEM

[76] Inventor: Chris W. Matthews, 3528 Kingshill Rd., B'ham, Ala. 35223

[21] Appl. No.: 09/261,383

[22] Filed: Mar. 3, 1999

[51] Int. Cl.[7] ..... E04G 11/08

[52] U.S. Cl. ..... 249/34; 249/18; 249/20; 249/24; 249/21; 52/653.2

[58] Field of Search ..... 249/13, 18, 20, 249/21, 24, 34; 52/653.2

[56] References Cited

U.S. PATENT DOCUMENTS

| | | | |
|---|---|---|---|
| 1,563,581 | 12/1925 | May | 249/24 |
| 2,251,775 | 8/1941 | Arrighini | 25/131 |
| 2,289,819 | 7/1942 | Wirtane | 25/131 |
| 2,614,311 | 10/1952 | Shook | 25/131 |
| 2,685,724 | 8/1954 | Peterson | 249/34 |
| 3,035,321 | 5/1962 | Hennig | 25/131 |
| 3,195,852 | 7/1965 | Lundell | 249/34 |
| 5,882,540 | 3/1999 | Farrington | 249/34 |
| 5,922,236 | 7/1999 | Zuhl | 249/34 |
| 6,016,633 | 1/2000 | Elwart | 52/294 |

*Primary Examiner*—Carl D. Friedman
*Assistant Examiner*—Phi Dieu Tran A
*Attorney, Agent, or Firm*—James D. Long

[57] ABSTRACT

An improved concrete forming system comprising a concrete forming unit which includes at least one pair of oppositely disposed and laterally spaced apart form segments Each form segment includes an upright wall forming section and a foundation footer forming section which extends outwardly from a lower end portion of its upright wall forming section. A panel member is detachably connected to the wall forming section of each form segment and is positioned to face a corresponding panel member of the oppositely disposed and laterally spaced apart form segment. The foundation footer forming section of each form segment includes adjustable members which permit limited height and width adjustments to selected portions of the foundation footer formed thereby

10 Claims, 4 Drawing Sheets

CONCRETE FORMING SYSTEM

BACKGROUND OF THE INVENTION

This invention relates to concrete forming systems and more particularly to an improved concrete forming system for monolithic pouring of foundation footers and upright walls of concrete structures which include limited width and height adjustments for the foundation footer.

Conventional concrete foundations and upright walls have heretofore been erected with the use of forms built from lumber and plywood material Typically, such concrete structures are formed in two parts with the footer being poured separately from the wall. A waterproofing membrane is normally installed between the footer and upright wall to form a watertight structure. This method is very expensive due to the high cost of lumber and labor to erect and remove the temporary forms once the footer and upright wall is poured and hardened.

Oftentimes, jobsite field changes to the foundation footer are required due to unknown elements in the terrain and other circumstances. Conventional wood forms can be changed on the jobsite to compensate for field changes and unknown terrain elements. However, form systems which utilize pre-manufactured or factory made welded wire reinforcing grids members are not easily changed in the field to compensate for such unknown elements that arise on the jobsite. U.S. Pat. No. 4,972,646 discloses such a form system where predetermined width welded wire grid members are positioned between stay in place insulated panels of an upright wall and footer form. While these systems provide insulation for the concrete structure and can be left in place, thus eliminating the expense of temporary form removal, they are lightweight and require knowledgeable labor to assemble correctly so that wall height and thickness and footer size and location can be properly controlled to reduce form uplift and lateral movement during pouring. To change in the field any dimensions of the foundation footer formed with this type system requires changing the dimensions of the stay in place panels and the premanufactured hooked end rods which extend between the panels.

Other inventions have been developed to reduce some of the above problems. U.S. Pat. No. 5,040,344 discloses a stay in place form system for insulated upright walls which utilizes superimposed polystyrene panels, horizontal stiffeners and fixed length hooked rods to form upright concrete walls of a thickness determined by the length of the hooked rods. When reinforcing rods or concrete reinforcing wire is required in the wall formed by this type system, excessive time and effort is required to assemble the insulated panels and horizontal stiffeners in place while connecting the fixed length hooked rods through the reinforcing rods to the horizontal stiffeners.

U.S. Pat. No. 3,881,291 discloses a panel mold for forming composite concrete reinforced walls. This system utilizes fixed length rods extending between spaced apart upright stay in place panel members with the ends of the rods anchored in place with bonding material. Due to the light weight material utilized for the walls, the thickness of the concrete wall capable of being formed by this system is limited to approximately 6 inches Any field changes to the foundation footer formed by this system would require additional labor to change the length of the fixed length rods and the dimensions of the stay in place panels utilized with system

SUMMARY OF THE INVENTION

In accordance with my present invention, I overcome the above and other difficulties by providing an improved concrete forming system for monolithic pouring of foundation footers and upright walls of concrete structures which utilize reusable form members that are simple to assemble and easy to adjust to desired dimensions or for changes to upright wall thickness and foundation footer dimensions required on the jobsite.

My improved forming system eliminates the need for a waterproofing membrane which is typically installed between the footer and upright wall with conventional two part pouring systems. It is an object of my present invention to provide a concrete forming system which utilizes less expensive supervised labor to set up and install the form members of my improved system as compared with laborers utilized with stay in place form systems described above. A further object of my invention is to provide an improved forming system which is of a substantial structure to reduce form uplift and lateral movement experienced during pouring with lightweight stay in place monolithic forming systems. Yet another object of my invention is to provide an improved concrete forming system that is reusable and easy to disassemble once the concrete structure is hardened My improved concrete forming system for pouring monolithically formed concrete structures comprises a concrete forming unit which includes at least one pair of oppositely disposed and laterally spaced apart form segments. Each form segment includes an upright wall forming section and a base foundation footer forming section which extends outwardly from a lower end portion of its upright wall forming section. A panel member is detachably connected to the wall forming section of each form segment in position to face a corresponding panel member of the oppositely disposed and laterally spaced apart form segment associated therewith. The foundation footer forming section of each form segment includes adjustable members which permits height and width adjustments to selected portions of the foundation footer formed thereby. A plurality of tie members extend transversely between and are detachably connected to upper end portions of the upright wall forming sections of each pair of oppositely disposed form segments. The tie members maintain the panel members carried by each form segment in a generally parallel, predetermined lateral spaced relation relative to each other.

BRIEF DESCRIPTION OF THE DRAWINGS

Apparatus embodying features of my invention is illustrated in the accompanying drawings, forming a part of this application in which.

DETAILED DESCRIPTION OF THE INVENTION

Figure 1:
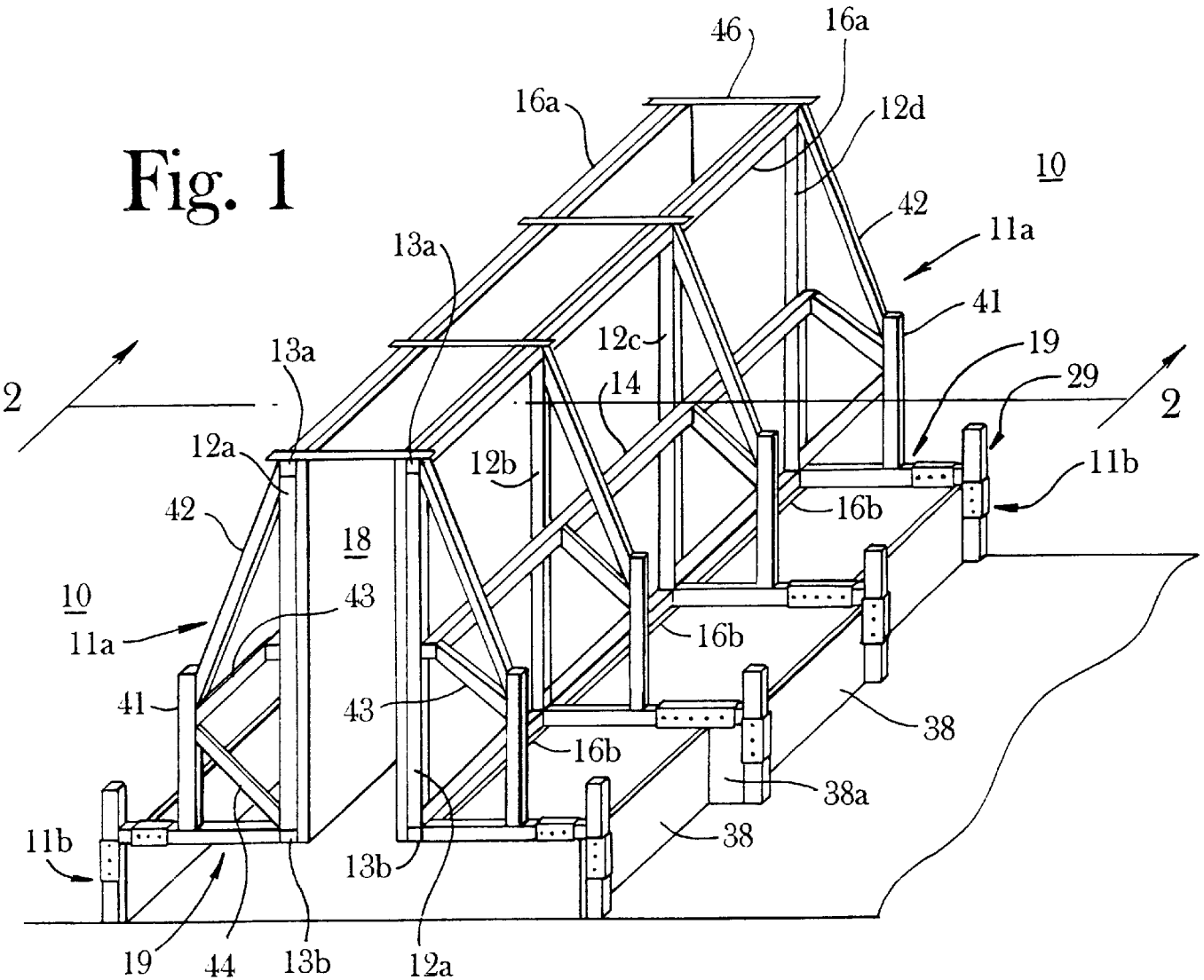
FIG. 1 is a perspective view of my improved form system assembled for pouring a monolithically formed Inverted "T" shaped concrete structure.
Figure 2:
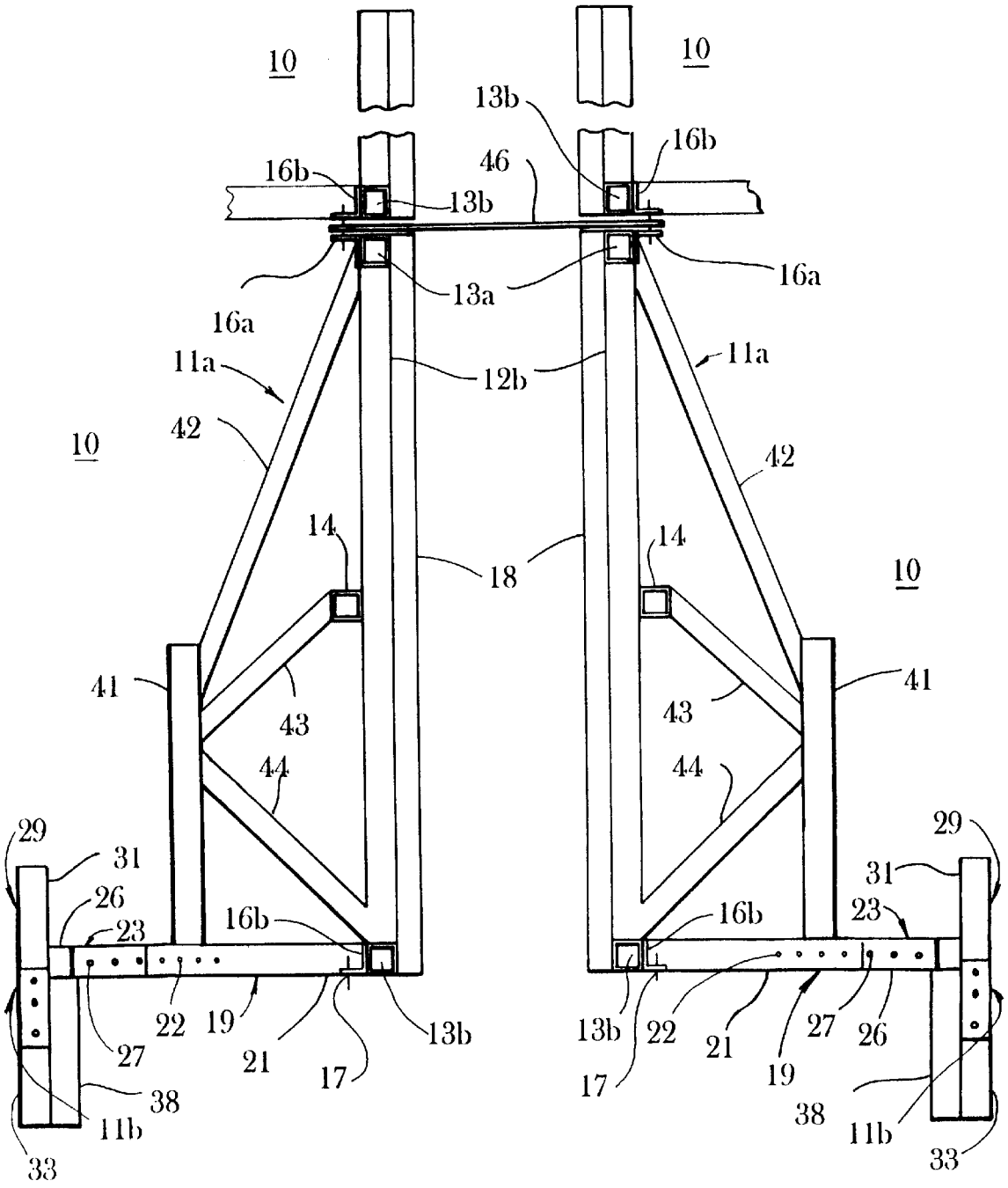
FIG. 2 is an enlarged, cross-sectional view of my improved form system taken generally along the line 2—2 of FIG. 1.

Referring now to the drawings for a better understanding of my invention, I show in FIG. 1 my improved concrete forming system for pouring monolithically formed structures which comprises a forming unit that consist of at least one pair of oppositely disposed and laterally spaced apart form segments which are indicated by the numeral 10. As shown in FIG. 2, the form segments 10 are constructed and arranged to face each other with each form segment including an upright wall forming section 11*a* and a foundation footer forming section 11*b*.

A plurality of spaced apart and longitudinally aligned upright wall forming members 12*a*, 12*b*, 12*c* and 12*d* are constructed and arranged as shown in the drawings to form each wall forming section 11*a*. Elongated, brace members 13*a* and 13*b* extend along and are rigidly connected to upper and lower end portions, respectfully, of the upright wall forming members, as shown A center brace member 14 extends along and is rigidly connected to a mid portion of the spaced apart, longitudinally aligned, wall forming members. In my preferred embodiment, the upright wall forming members 12*a*, 12*b*, 12*c* and 12*d*, brace members 13*a* and 13*b* and center brace member 14 are predetermined sized structural tubular members which are welded to each other as shown. The brace members are constructed and arranged to maintain the upright wall forming members in longitudinal aligned, spaced relation relative to each other.

Oppositely disposed connector members 16*a*, 16*b* are carried by upper and lower brace members 13*a* and 13*b*, respectfully, as shown in FIG. 2. In my preferred embodiment, the connector member 16*a* is a predetermined size structural angle which extends along and is rigidly connected to the brace member 13*a* of each form segment 10. In FIG. 1, I show three separate structural angle connector members 16*b* carried by the brace member 13*b* of each form segment 10. The connector members 16*a* and 16*b* are provided with a plurality of longitudinally aligned, spaced apart openings 17, as shown.

A panel member 18, such as a 4'×8' piece of plyform (plywood), is detachably connected to the upright wall forming members 12*a*, 12*b*, 12*c* and 12*d* of each form segment 10 with a multiplicity of countersunk conventional fasteners(not shown). The panel member 18 is carried by each form segment 10 in a generally upright position which faces a corresponding panel member of an oppositely disposed form segment 10, as shown in FIG. 2.

Figure 3:
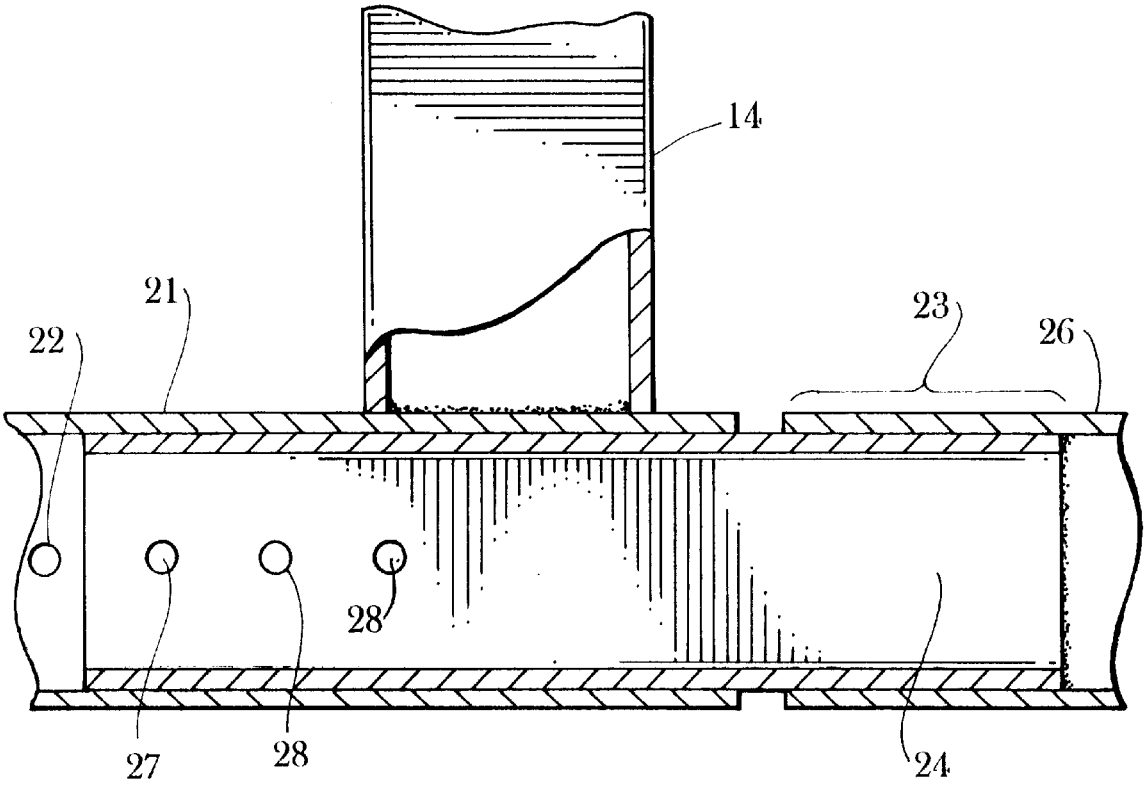
FIG. 3 is an enlarged, fragmented cross-sectional view showing width adjustable elements of a foundation footer forming section of my improved forming system.

Each footer forming section 11*b* comprises a plurality of horizontally extending, adjustable form elements 19 with each form element extending outwardly from the lower end portion of each of the upright wall forming members 12*a*, 12*b*, 12*c* and 12*d*. Each form element 19 is rigidly connected at one end to the brace member 13*b* and is formed from a telescoping tubular arrangement shown in FIG. 3. The form element 19 includes an outer tubular member 21 of a predetermined size and length which is provided with a multiplicity of spaced apart openings 22 extending therethrough as shown. The tubular member 21 is constructed and arranged to slidably receive an inner tubular assembly 23 which is formed from structural tubular members 24 and 26. A multiplicity of spaced apart openings 27 are provided in inner tubular member 24 in position to align with openings 22 in outer tubular member 21 and receive at least two locking members 28 which may be in the form of a conventional bolt and nut or L-shaped locking pin. As shown in FIG. 1, this telescoping tubular arrangement provides limited foundation footer width adjustment to all or selected portions of the foundation footer formed by each form segment 10.

Figure 4:
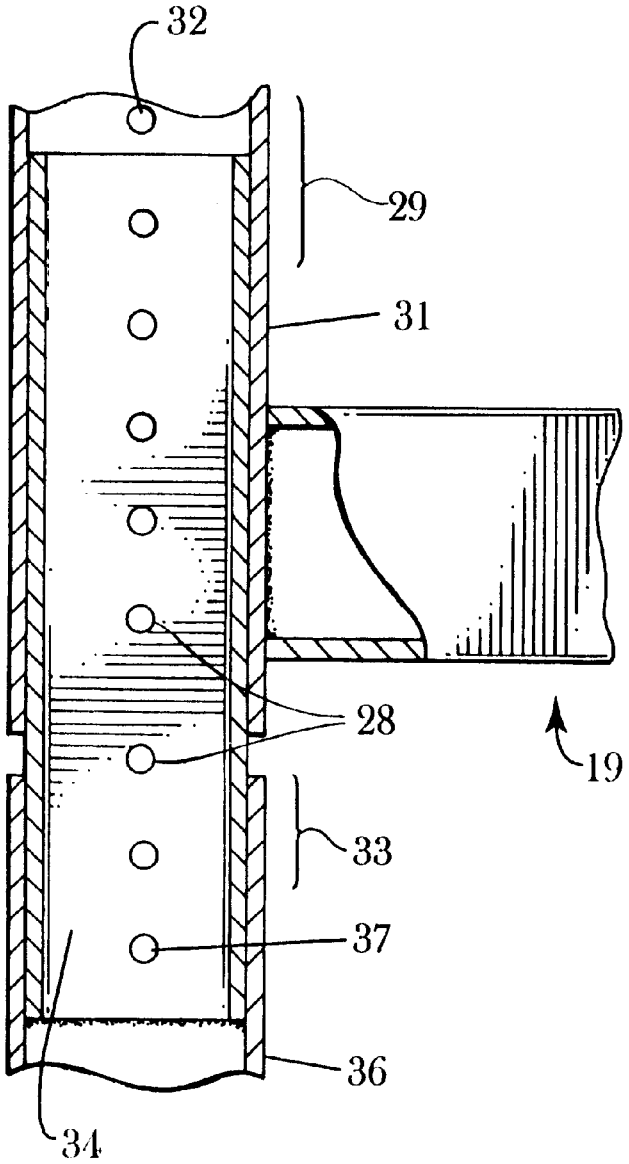
FIG. 4 is an enlarged, fragmented cross-sectional view showing height adjustment elements of the foundation footer forming section; and, FIG. 5 is a view showing a tie member employed with my improved concrete forming system

As shown in FIGS. 2 & 4, an upright adjustable form element 29 is connected to an outer end of each form element 19. The upright form element 29 comprises a similar telescoping tubular arrangement as that of form element 19 wherein an outer tubular member 31 having a multiplicity of spaced apart opening 32 therethrough is constructed and arranged to slidably receive an inner tubular assembly 33. Structural tubular members 34 and 36 form the inner tubular assembly 33 and are arranged in a similar manner as tubular members 24 and 26. Spaced apart opening 37 are provided in tubular member 34 which are positioned to align with openings 32 in outer tubular element 32 and receive a locking member 28. Footer panel members 38 and 38*a*, which may be in the form of a predetermined size piece of plyform material, are detachably connected to the upright adjustable form elements 29, as shown. The telescoping tubular form elements 29 provide a limited foundation footer height adjustment in a similar manner as form element 19 for the foundation footer width. If all adjustable form elements 19 and 29 are adjusted to the same position, the footer panel member 38 will be a one piece form board extending the length of its form segment 10. However, in FIG. 1, I show form segments 19 extending outwardly from upright wall members 12*b* and 12*c* and being adjusted so that the mid portion of the foundation footer is wider than the two end portions With this arrangement, footer panel members 38*a* are employed along with panel members 38 to form the exterior perimeter of the foundation footer.

As shown in FIG. 2, an upright structural member 41 is rigidly connected to each outer tubular member 21 of the form element 19. Knee brace members 42, 43 and 44 extend between each structural member 41 and its upright wall forming member 12*a*, 12*b*, 12*c* or 12*d*. The knee bracing arrangement works in combination with bracing members 13*a*, 13*b* and 14 to maintain a rigid right angle relationship between each upright wall forming section 11*a* and its footer foundation forming section 11*b*. In my preferred embodiment, the structural member 41 and knee brace members 42, 43, and 44 are tubular members of a predetermined size and length.

Figure 5:
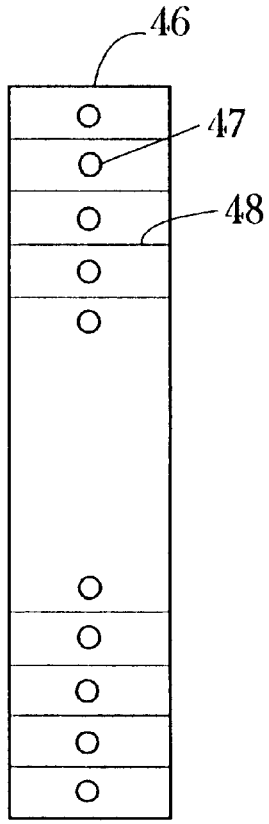

In FIG. 5, I show a tie member 46 which is provided with a plurality of spaced apart and longitudinally aligned openings 47 that are identical in diameter to openings 17 in the connector elements 16*a* & 16*b* . The tie member 46 may be embedded in concrete structures and includes bendable breakaway creases 48. The tie members 46 are constructed and arranged to detachably connect to the connector elements 16*a*, 16*b* and hold oppositely disposed form segments 10 in generally upright, lateral spaced relation from each other, as shown in FIGS. 1 & 2.

While I have shown and described only one pair of form segments 10 as being utilized to form inverted "T" shaped concrete structures, it will be apparent to those skilled in the art to which my invention relates, that additional pairs of oppositely disposed form segments may placed in contiguous alignment with the original pair of form segments to form an elongated, inverted "T" shaped concrete structure.

From the foregoing, the operation of my improved concrete forming system will be readily understood. The user must employ at least one pair form segments 10 with each form segment having its upright panel member 18 assembled in place. Footer adjustable elements 19 and 29 are then adjusted to the desired footer width and height required. The form segments 10 are then placed in an upright, oppositely disposed, lateral spaced apart position relative to each other with the panel members of the form segment 10 facing each other as shown in FIG. 1. Tie members 46 are then detachably connected to the connector members 16*a* of the two form segments 10. This rigid, right angle assembly formed by each form segment 10 works in combination with tie members 46 to hold the panel members 18 of each pair of form segments in an upright generally parallel, spaced apart postion from each other. Footer panel members 38 and 38*a,* if required, are then detachably connected to the form elements. Finally, precut pieces of plyform material may be employed to enclose both ends of the spaced apart form segments 10. Once the concrete is hardened, the tie member 46 and form segments 10 are removed, thus leaving a one piece inverted "T" shaped concrete structure.

In FIG. 2, I show an additional embodiment of my invention which utilizes an additional pair of oppositely disposed form segments 10 that are stacked above the original pair of form segments 10. Connector members 16*b* of the additional pair of form segments 10 are detachably connected to connector members 16*a* of the original pair of form segments. Not shown, are additional tie members 46 which are bolted to connector members 16*a* carried by upper brace members 13*a* of the additional form segments 10. This stacked arrangement of form segments 10 permit the user to form inverted "T" shaped concrete structures with additional height upright walls.

While I have shown my invention but in two forms, it will be obvious to those skilled in the art to which my invention relates that it is not so limited, but is susceptible of various changes and modifications without departing from the spirit thereof, and I desire, therefore, that only such limitations shall be placed thereupon as are specifically set forth in the appended claims.

What I claim is:

1. A. concrete forming system for pouring monolithically formed concrete structures with said system comprising;

a. a concrete forming unit which includes at least one pair of oppositely disposed and laterally spaced apart form segments positioned and arranged to face each other, b. each said form segment includes an upright wall forming section having an upper end portion and a lower end portion and a foundation footer forming section which extends outwardly from the lower end portion of its upright wall forming section, c. bracing means for maintaining each said upright wall forming section in a rigid, generally right angle relationship with its footer forming section, e. each said footer forming section including slidable members constructed and arranged to permit height and width adjustments to segments of the foundation footer formed thereby; and f. at least two tie members extending between and detachably connected to upper end portions of said pair of oppositely disposed form segments with said tie members constructed and arranged to maintain said oppositely disposed form segments in lateral spaced relation relative to each other.

2. A concrete forming system as defined in claim 1 wherein each said wall forming section comprises a plurality of upright wall forming members which are spaced apart and longitudinally aligned relative to each other.

3. A concrete forming system as defined in claim 2 wherein each said wall forming member is a structural tubular member.

4. A concrete forming system as defined in claim 2 wherein bracing members extend along and are rigidly connected to upper and lower end portions of said upright wall forming members of each said wall forming section.

5. A concrete forming system as defined in claim 2 wherein a panel member is carried by said plurality of upright wall forming members in position to face a corresponding panel member carried by wall forming members of the oppositely disposed form segment.

6. A concrete forming system as defined in claim 2 wherein each said foundation footer forming section includes a plurality of horizontally extending, adjustable form elements with each said form element extending outwardly from and connected to the lower end portion of said upright wall forming member adjacent thereto.

7. A concrete forming system as defined in claim 6 wherein each said form element comprises a telescoping tubular arrangement wherein an outer tubular member having a multiplicity of spaced apart and longitudinally aligned openings extending therethrough is constructed and arranged to slidably received an inner tubular member provided with spaced apart openings and longitudinally aligned openings which are positioned and arranged to align with said openings in said outer tubular member and received at least two locking members.

8. A concrete forming system as defined in claim 7 wherein an upright adjustable form element is connected to an outer end portion of each horizontally extending form element.

9. A concrete forming system as defined in claim 8 wherein each said upright adjustable form element comprises a telescoping tubular arrangement which includes a vertically extending, outer tubular member having a plurality of spaced apart openings therethrough and which is constructed and arranged to slidably received an inner tubular member provided with spaced apart and longitudinally aligned openings which are constructed and arranged to align with said openings in said vertically extending, outer tubular member and received a locking member.

10. A concrete forming system as defined in claim 9 wherein a footer panel member is detachably connected to said upright adjustable form elements to form the exterior perimeter of the foundation footer formed thereby.

* * * * *